US011239590B2

(12) United States Patent
Yang et al.

(10) Patent No.: US 11,239,590 B2
(45) Date of Patent: Feb. 1, 2022

(54) ELECTRICAL CONNECTOR WITH REDUCED RESONANCE BETWEEN GROUND TERMINALS

(71) Applicant: LOTES CO., LTD, Keelung (TW)

(72) Inventors: Qi Xiao Yang, Keelung (TW); Ming Jiang, Keelung (TW); Yong Fu Wang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/001,819

(22) Filed: Aug. 25, 2020

(65) Prior Publication Data

US 2021/0218169 A1 Jul. 15, 2021

(30) Foreign Application Priority Data

Jan. 13, 2020 (CN) ..... 202010029842.5

(51) Int. Cl.

| | |
|---|---|
| ***H01R 24/60*** | (2011.01) |
| ***H01R 12/73*** | (2011.01) |
| ***H01R 12/75*** | (2011.01) |
| ***H01R 12/79*** | (2011.01) |
| ***H01R 13/50*** | (2006.01) |
| ***H01R 13/652*** | (2006.01) |

(52) U.S. Cl.

CPC ..... *H01R 12/73* (2013.01); *H01R 12/75* (2013.01); *H01R 12/79* (2013.01); *H01R 13/50* (2013.01); *H01R 13/652* (2013.01)

(58) Field of Classification Search

CPC ..... H01R 12/73; H01R 13/652; H01R 13/50; H01R 12/79; H01R 12/75

USPC ..... 439/646

See application file for complete search history.

(56) References Cited

U.S. PATENT DOCUMENTS

| | | | | |
|---|---|---|---|---|
| 10,044,145 | B2 | 8/2018 | Kondo | |
| 10,367,308 | B2 * | 7/2019 | Little | H01R 13/6471 |
| 10,553,971 | B1 * | 2/2020 | Phillips | H01R 12/716 |

(Continued)

FOREIGN PATENT DOCUMENTS

| | | | |
|---|---|---|---|
| CN | 109314334 | A | 2/2019 |
| CN | 110311242 | A | 10/2019 |
| CN | 110336162 | A | 10/2019 |

*Primary Examiner* — Abdullah A Riyami
*Assistant Examiner* — Nelson R. Burgos-Guntin
(74) *Attorney, Agent, or Firm* — Locke Lord LLP; Tim Tingkang Xia, Esq.

(57) ABSTRACT

An electrical connector includes an insulating block and multiple terminals arranged along a left-right direction of the insulating block. The insulating block has multiple opening holes along a vertical direction thereof. Each terminal has a fixing portion fixed to the insulating block. The fixing portion has an adjustment portion. The terminals in one row include multiple first ground terminals, multiple second ground terminals and multiple pairs of differential signal terminals, correspondingly arranged along the left-right direction sequentially as: one of the first ground terminals, one of the pairs of differential signal terminals, one of the second ground terminals, another one of the pairs of differential signal terminals, and another one of the first ground terminals. The adjustment portion of each second ground terminal is exposed in the opening hole along the vertical direction, and the adjustment portion of each first ground terminal is not exposed in the opening hole.

12 Claims, 13 Drawing Sheets

(56) References Cited

U.S. PATENT DOCUMENTS

| | | | | |
|---|---|---|---|---|
| 2014/0227898 | A1* | 8/2014 | Zhang | H01R 13/6582 439/345 |
| 2015/0140866 | A1* | 5/2015 | Tsai | H01R 12/724 439/637 |
| 2015/0229082 | A1* | 8/2015 | Yu | H01R 13/6587 439/607.11 |
| 2019/0148887 | A1* | 5/2019 | Chen | H01R 13/6471 439/660 |
| 2019/0173232 | A1* | 6/2019 | Lu | H01R 13/6272 |
| 2020/0099149 | A1* | 3/2020 | Xu | H01R 13/6461 |
| 2020/0227846 | A1* | 7/2020 | Lin | B29C 45/14065 |
| 2021/0075159 | A1* | 3/2021 | Wang | H01R 13/631 |
| 2021/0135405 | A1* | 5/2021 | Wu | H01R 13/6471 |

* cited by examiner

B–B

B–B

D-D

ELECTRICAL CONNECTOR WITH REDUCED RESONANCE BETWEEN GROUND TERMINALS

CROSS-REFERENCE TO RELATED PATENT APPLICATION

This non-provisional application claims priority to and the benefit of, pursuant to 35 U.S.C. § 119(a), patent application Serial No. CN202010029842.5 filed in China on Jan. 11, 2020. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector improving high frequency characteristics.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector includes an insulating body having an insertion slot, and terminals in two rows respectively assembled to the insulating body. The terminals in each row include a plurality of pairs of differential signal terminals and a plurality of ground terminals. Each of two sides of each pair of differential signal terminals is provided with one of the ground terminals to block the crosstalk interference between two adjacent pairs of differential signal terminals. Each of the terminals has a fixing portion fixed to the insulating body, a contact portion exposed to the insertion slot and mated with a mating component, and a soldering portion extending backward from the fixing portion out of the insulating body to be soldered to a circuit board.

However, with the technology level being increasingly high in recent years, the requirements for the frequencies of signals transmitted by the electrical connectors are higher, and the requirements of the high frequency characteristics for the electrical connector are also higher. Since the fixing portions of the two ground terminals respectively located at the two sides of each pair of differential signal terminals are both fixed to the insulating body, the medium surrounding each of the two ground terminals is plastic, the dielectric coefficients of the media surrounding the two ground terminals are identical, the electromagnetic energies of the media surrounding the two ground terminals are identical, and the wave peaks of the electromagnetic waves of the media surrounding the two ground terminals may superimpose and add to each other. Thus, the resonance between the two ground terminals is significant, which may easily generate ground resonance, thereby seriously affect the high frequency characteristics of the electrical connector without satisfying the requirements for the transmission of high frequency signals.

Therefore, a heretofore unaddressed need to design a new electrical connector exists in the art to address the aforementioned deficiencies and inadequacies.

SUMMARY

The present invention is directed to an electrical connector, in which no opening hole is provided at the location of the adjustment portion of the first ground terminal on the insulating block, and an opening hole is provided at the location of the adjustment portion of the second ground terminal on the insulating block, such that the dielectric coefficients of the media surrounding the two ground terminals are not identical, the electromagnetic energies of the media surrounding the two ground terminals are not identical, and the wave peaks of the electromagnetic waves of the media surrounding the two ground terminals do not superimpose and add to each other, thereby reducing the resonance between the first ground terminal and the second ground terminal, and preventing from the ground resonance phenomenon.

To achieve the foregoing objective, the present invention adopts the following technical solutions.

An electrical connector includes: an insulating block, having at least one opening hole along a vertical direction thereof; and a plurality of terminals arranged in at least one row along a left-right direction of the insulating block, wherein each of the terminals has a fixing portion fixed to the insulating block, and the fixing portion has an adjustment portion, wherein the terminals in one row comprise at least two first ground terminals, at least one second ground terminal and at least two pairs of differential signal terminals, correspondingly arranged along the left-right direction sequentially as: one of the first ground terminals, one of the pairs of differential signal terminals, one of the second ground terminals, another one of the pairs of differential signal terminals, and another one of the first ground terminals, wherein the adjustment portion of each of the at least one second ground terminal is exposed in the opening hole along the vertical direction, and the adjustment portion of each of the at least two first ground terminals is not exposed in the opening hole.

In certain embodiments, a left side surface and a right side surface of the adjustment portion of each of the at least one second ground terminal are exposed in the opening hole.

In certain embodiments, a distance from a left side surface of the opening hole to the second ground terminal is equal to a distance from a right side surface of the opening hole to the second ground terminal.

In certain embodiments, each of the pairs of differential signal terminals comprises a first signal terminal and a second signal terminal, and a right side surface of the adjustment portion of the second signal terminal of the one of the pairs of differential signal terminals at a left side of the second ground terminal and a left side surface of the adjustment portion of the first signal terminal of the another one of the pairs of differential signal terminals at a right side of the second ground terminal are at least partially exposed in a same opening hole.

In certain embodiments, an area of the second signal terminal of the one of the pairs of differential signal terminals at the left side of the second ground terminal exposed in the opening hole is equal to an area of the first signal terminal of the another one of the pairs of differential signal terminals at the right side of the second ground terminal exposed in the opening hole.

In certain embodiments, each of the pairs of differential signal terminals comprises a first signal terminal and a second signal terminal, and a right side surface of the adjustment portion of the second signal terminal of the one of the pairs of differential signal terminals at a left side of the second ground terminal and a left side surface of the adjustment portion of the first signal terminal of the another one of the pairs of differential signal terminals at a right side of the second ground terminal are not exposed in a same opening hole.

In certain embodiments, the electrical connector further includes an insulating body, wherein the insulating body has an insertion slot concavely provided backward for an electronic component to insert therein, the insertion slot has a stopping surface, the electronic component abuts the stopping surface, the insulating block is located in the insulating body, a front end of the insulating block has a front surface located behind the stopping surface, each of the terminals has an extending portion extending forward from the fixing portion to pass beyond the front surface but not to pass beyond the stopping surface, a partition exists between any two adjacent ones of the extending portions of the terminals in a same row, a first gap exists between the partition and each of the two adjacent ones of the extending portions, and air is located in the first gap.

In certain embodiments, the opening hole is provided at a side close to the front surface, the insulating body has a receiving cavity, the insulating block and the terminals in one row are located in the receiving cavity, a second gap exists between each of the terminals and an inner wall of the receiving cavity, and air is located in the second gap.

In certain embodiments, a width of the adjustment portion is less than a width of the extending portion, and a distance between the adjustment portions of two adjacent of the terminals in the same row is greater than a distance between the extending portions of the two adjacent of the terminals in the same row.

In certain embodiments, the electrical connector includes two insulating blocks, wherein the terminals are arranged in an upper row and a lower row and aligned vertically, the terminals in one of the two rows comprise at least two first ground terminals, at least one second ground terminal and at least two pairs of differential signal terminals, the terminals in the other of the two rows comprise at least one first ground terminal, at least two second ground terminals and at least two pairs of differential signal terminals, and the opening holes on the two insulating blocks are staggered along the thickness direction of the insulating blocks.

In certain embodiments, the electrical connector includes three insulating blocks, wherein the three insulating blocks comprise a first insulating block, a second insulating block and a third insulating block, the terminals are arranged in an upper row and a lower row, the terminals in the upper row are injection molded with the first insulating block, the fixing portions of the terminals in the upper row are fixed to the first insulating block, the terminals in the lower row are injection molded with the second insulating block and the third insulating block, the fixing portion of each of the terminals in the lower row comprises a first fixing portion and a second fixing portion, the first fixing portion is fixed to the second insulating block, the second fixing portion is fixed to the third insulating block, a length of the fixing portion of each of the terminals in the upper row is greater than a length of the first fixing portion of each of the terminals in the lower row, and the length of the fixing portion of each of the terminals in the upper row is greater than a length of the second fixing portion of each of the terminals in the lower row.

In certain embodiments, the first fixing portion of each of the terminals in the lower row has a first adjustment portion, the second fixing portion of each of the terminals in the lower row has a second adjustment portion, the first adjustment portion and the second adjustment portion of each of the second ground terminals in the lower row are both exposed in the opening hole, and the first adjustment portion and the second adjustment portion of the first ground terminal in the lower row are not exposed in the opening hole.

Compared with the related art, certain embodiments of the present invention have the following beneficial effects.

In the transmission module of the first ground terminal-pair of differential signal terminals-second ground terminal-pair of differential signal terminals-first ground terminal, the adjustment portion of the second ground terminal is exposed in the opening hole, and the adjustment portions of the two first ground terminals are not exposed in the opening hole. The medium surrounding the adjustment portion of the second ground terminal is air, and the medium surrounding the adjustment portion of each of the first ground terminals is plastic. Thus, the dielectric coefficient of the medium surrounding the second ground terminal is less than the dielectric coefficient of the medium surrounding each of the first ground terminals, such that the electromagnetic energy of the second ground terminal and the electromagnetic energy of each of the first ground terminals are not identical, and the electromagnetic wave of the second ground terminal and the electromagnetic wave of each of the first ground terminals do not superimpose and add to each other, thereby reducing the resonance between the second ground terminal and the first ground terminals, and preventing from the ground resonance phenomenon.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
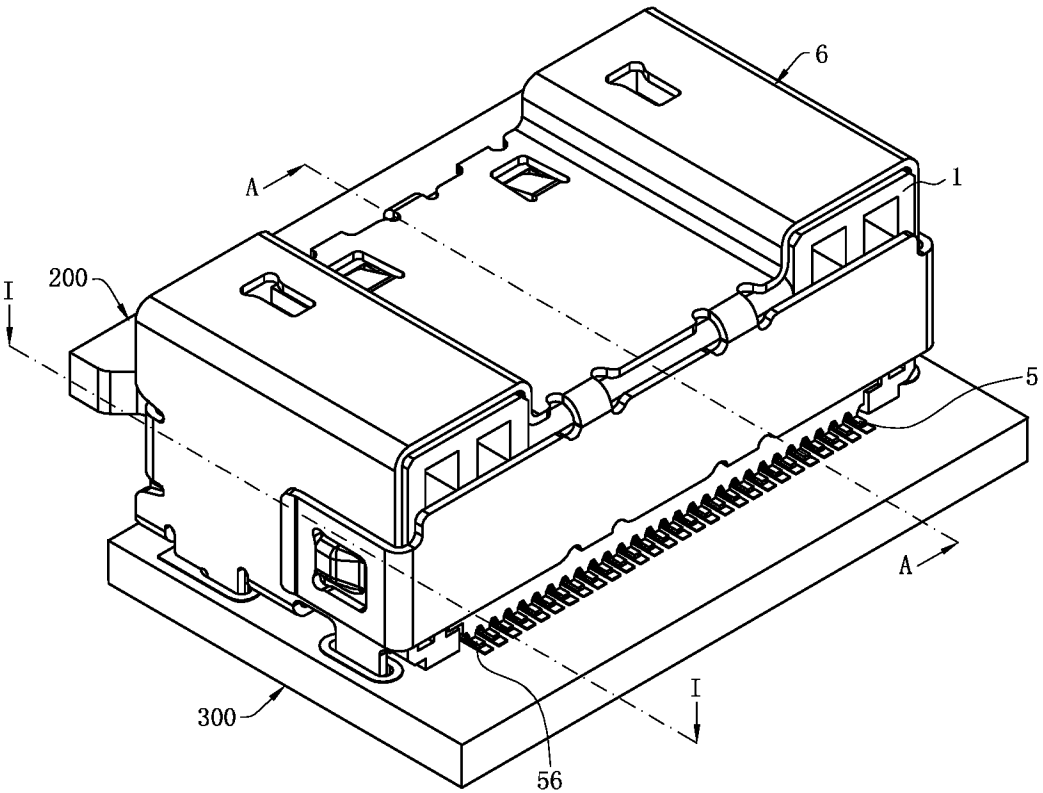
FIG. 1 is a perspective assembled view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-13. In accordance with the purposes of this invention, as embodied and broadly described herein, this invention, in one aspect, relates to an electrical connector.

Figure 2:
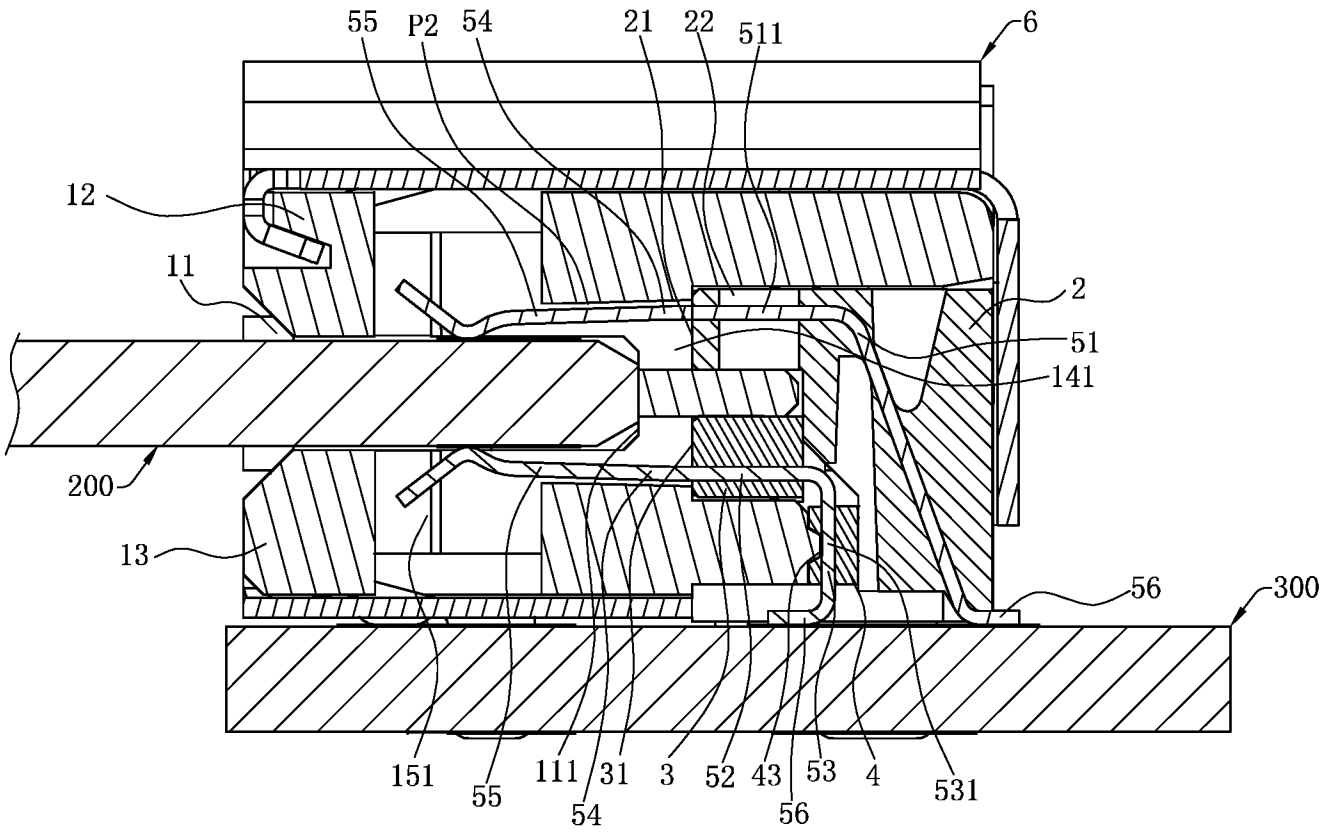
FIG. 2 is a sectional view of FIG. 1 along a line A-A.
Figure 3:
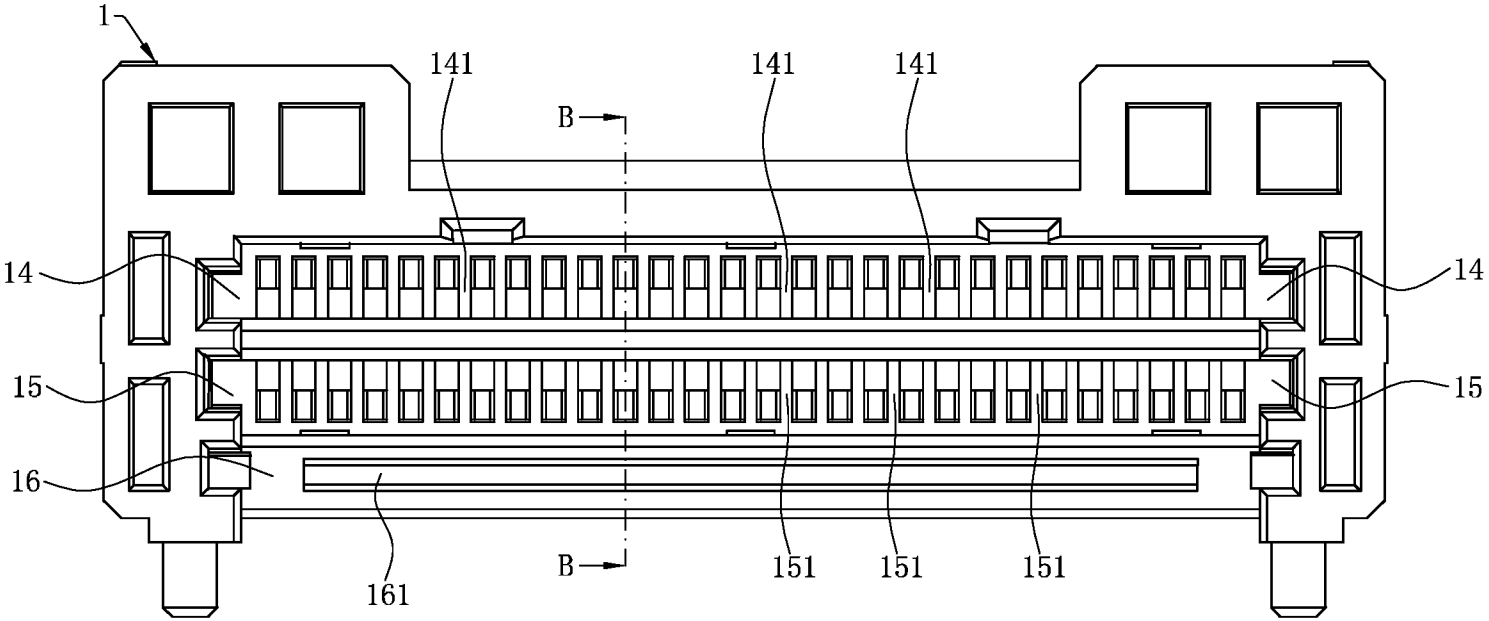
FIG. 3 is a rear view of an insulating body of the electrical connector according to the first embodiment of the present invention.

As shown in FIG. 1 to FIG. 3, an electrical connector 100 is configured to electrically connect a mating component 200 and a circuit board 300, and to transmit the high frequency signal of the mating component 200 to the circuit board 300. The mating component 200 can be a component such as a cable, an electronic card, a flexible circuit board, etc. In this embodiment, the mating component 200 is an electronic card. The electrical connector 100 includes an insulating body 1. A first insulating block 2, a second insulating block 3 and a third insulating block 4 are assembled to the insulating body 1. The first insulating block 2 and a plurality of terminals 5 in an upper row are formed by injection molding, and the terminals 5 in the upper row are arranged at intervals along a left-right direction of the first insulating block 2. The second insulating block 3, the third insulating block 4 and a plurality of terminals 5 in a same lower row are formed by injection molding, and the terminals 5 in the lower row are arranged at intervals along the left-right direction of the second insulating block 3 and the third insulating block 4. Further, a metal shell 6 wraps outside the insulating body 1.

Figure 4:
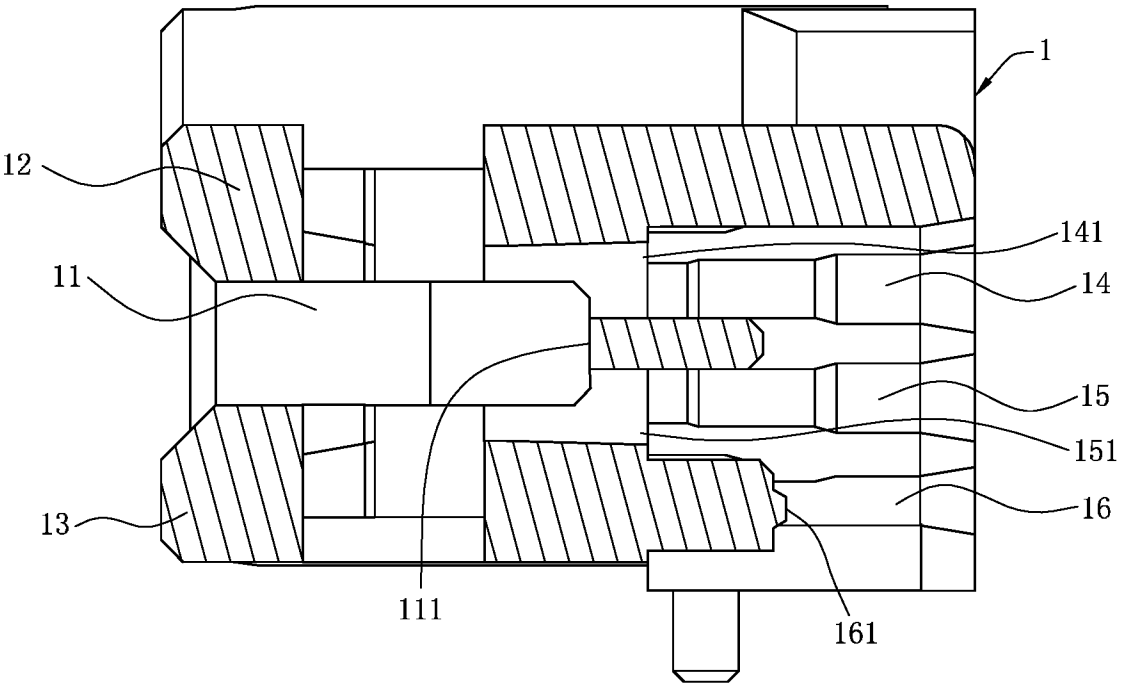
FIG. 4 is a sectional view of FIG. 3 along a line B-B.

As shown in FIG. 2 to FIG. 4, the insulating body 1 has an insertion slot 11 concavely provided backward for the mating component 200 to insert therein. The insertion slot 11 has a stopping surface 111, and the mating component 200 abuts the stopping surface 111. An upper side and a lower side of the insertion slot 11 are respectively a first side wall 12 and a second side wall 13. The insulating body 1 is concavely provided with a first receiving cavity 14, a second receiving cavity 15 and a third receiving cavity 16 forward from back thereof. The first receiving cavity 14 and the second receiving cavity 15 are provided right opposite vertically. The first receiving cavity 14 extends from a back end of the insulating body 1 forward to the first side wall 12. The second receiving cavity 15 extends from the back end of the insulating body 1 forward to the second side wall 13. The first receiving cavity 14 has a plurality of first partitions 141 to separate the terminals 5 in the upper row, and the second receiving cavity 15 has a plurality of second partitions 151 to separate the terminals 5 in the lower row.

Figure 6:
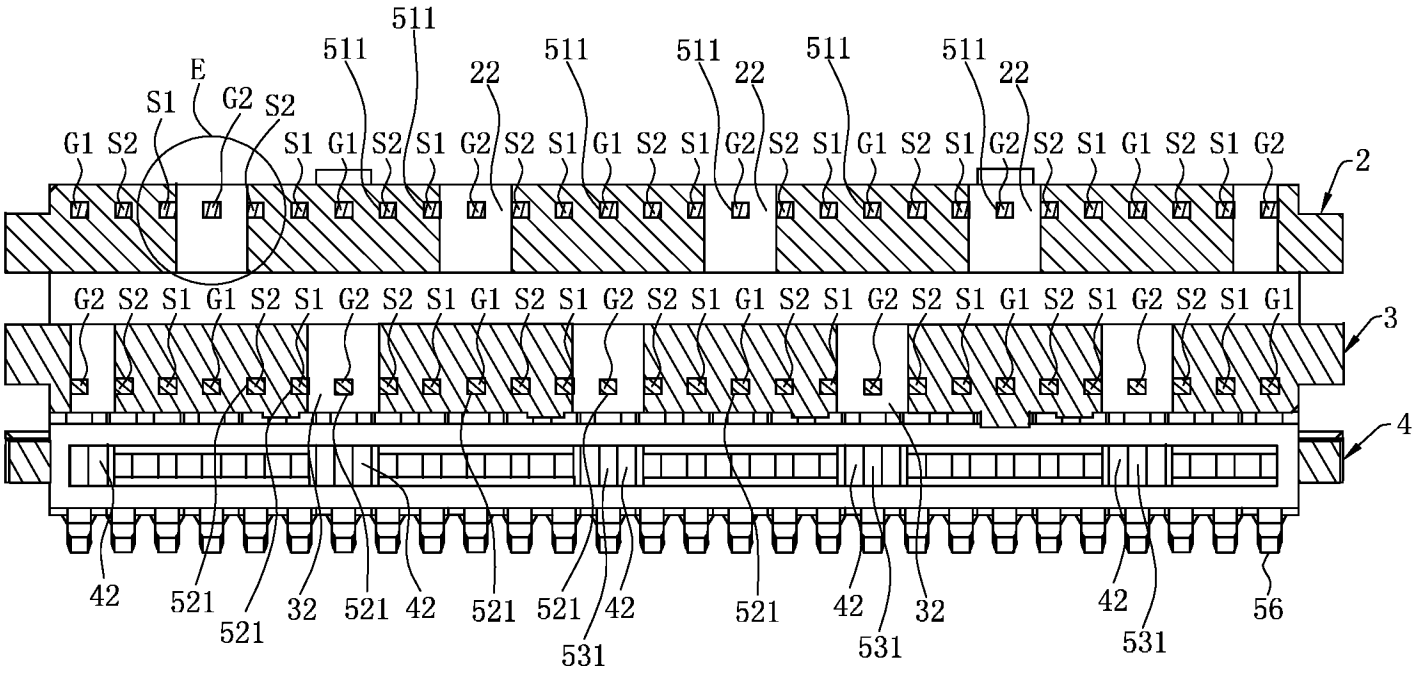
FIG. 6 is a sectional view of FIG. 5 along a line C-C.

As shown in FIG. 2, FIG. 4 and FIG. 6, the first insulating block 2 and the insulating body 1 are formed individually. The first insulating block 2 and the terminals 5 in the upper row are injection molded, and are then assembled to the first receiving cavity 14. The first insulating block 2 has a first front surface 21. The terminals 5 in the upper row extends from the first front surface 21 forward to enter the first side wall 12. The first insulating block 2 is provided with a plurality of first opening holes 22 arranged at intervals along the left-right direction, and each of the first opening holes 22 runs therethrough along a vertical direction of the first insulating block 2. The second insulating block 3 and the insulating body 1 are formed individually. The third insulating block 4 and the insulating body 1 are formed individually. The second insulating block 3, the third insulating block 4 and the terminals 5 in the same lower row are injection molded, and then the second insulating block 3 is assembled to the second receiving cavity 15, the third insulating block 4 is assembled to the third receiving cavity 16, and the terminals 5 in the lower row are received in the second receiving cavity 15 and the third receiving cavity 16. The second insulating block 3 has a second front surface 31. The terminals 5 in the lower row extends from the second front surface 31 forward to enter the second side wall 13. The second insulating block 3 is provided with a plurality of second opening holes 32 arranged at intervals along the left-right direction, and each of the second opening holes 32 runs therethrough along the vertical direction of the second insulating block 3. The third insulating block 4 is provided with a plurality of third opening holes 42 arranged at intervals along the left-right direction, and each of the third opening holes 42 runs therethrough along a front-rear direction of the third insulating block 4.

The first insulating block 2, the second insulating block 3, the third insulating block 4 and the insulating body 1 are individually formed. In other embodiments, the first insulating block 2, the second insulating block 3 and the third insulating block 4 may be formed integrally with the insulating body 1, and the first opening holes 22, the second opening holes 32 and the third opening holes 42 do not need to run through the first insulating block 2, the second insulating block 3 and the third insulating block 4.

Figure 8:
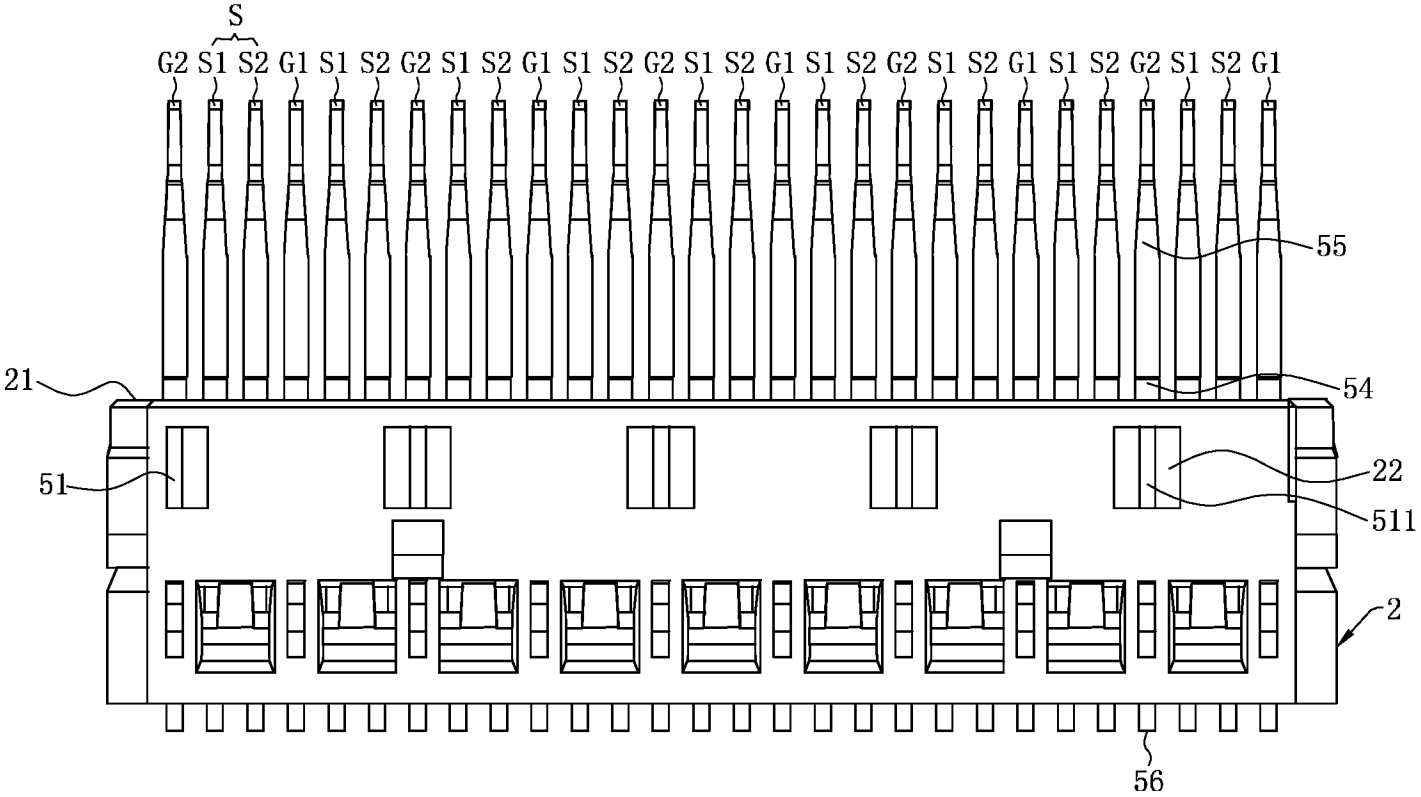
FIG. 8 is a top view of FIG. 5.

As shown in FIG. 2, FIG. 6 and FIG. 8, the terminals 5 are arranged in the upper row and the lower row and are provided to be aligned vertically. Each terminal 5 in the upper row includes a fixing portion 51 fixed in the first insulating block 2. An extending portion 54 is formed by extending forward from the fixing portion 51 to pass beyond the first front surface 21 but not to pass beyond the stopping surface 111. A contact arm 55 is formed by extending forward from the extending portion 54, and the contact arm 55 abuts the mating component 200. A soldering portion 56 is formed by extending downward from the extending portion 51, and the soldering portion 56 is soldered to the circuit board 300. Referring to FIG. 2, FIG. 4, FIG. 11 and FIG. 12, one of the first partitions 141 exists between any two adjacent extending portions 54 to reduce the interference between the extending portions 54 of the terminals 5 in the upper row. A first gap P1 exists between each first partition 141 and each of the extending portions 54. Further, the extending portion 54 and the contact arm 55 of each of the terminals 5 in the upper row are accommodated in the first receiving cavity 14, a second gap P2 exists between the extending portion 54 and the contact arm 55 of each of the terminals 5 in the upper row and an inner wall of the first receiving cavity 14, and air is located in the first gaps P1 and the second gaps P2. The extending portion 54 and the contact arm 55 of each of the terminals 5 in the upper row are accommodated in the first receiving cavity 14 and surrounded by the first partitions 141 and air, and the media surrounding them include mostly plastic medium and certain amount of air medium, thereby adjusting the impedance value of the extending portion 54 and the contact arm 55 of each of the terminals 5 in the upper row to be in a proper impedance range.

Figure 5:
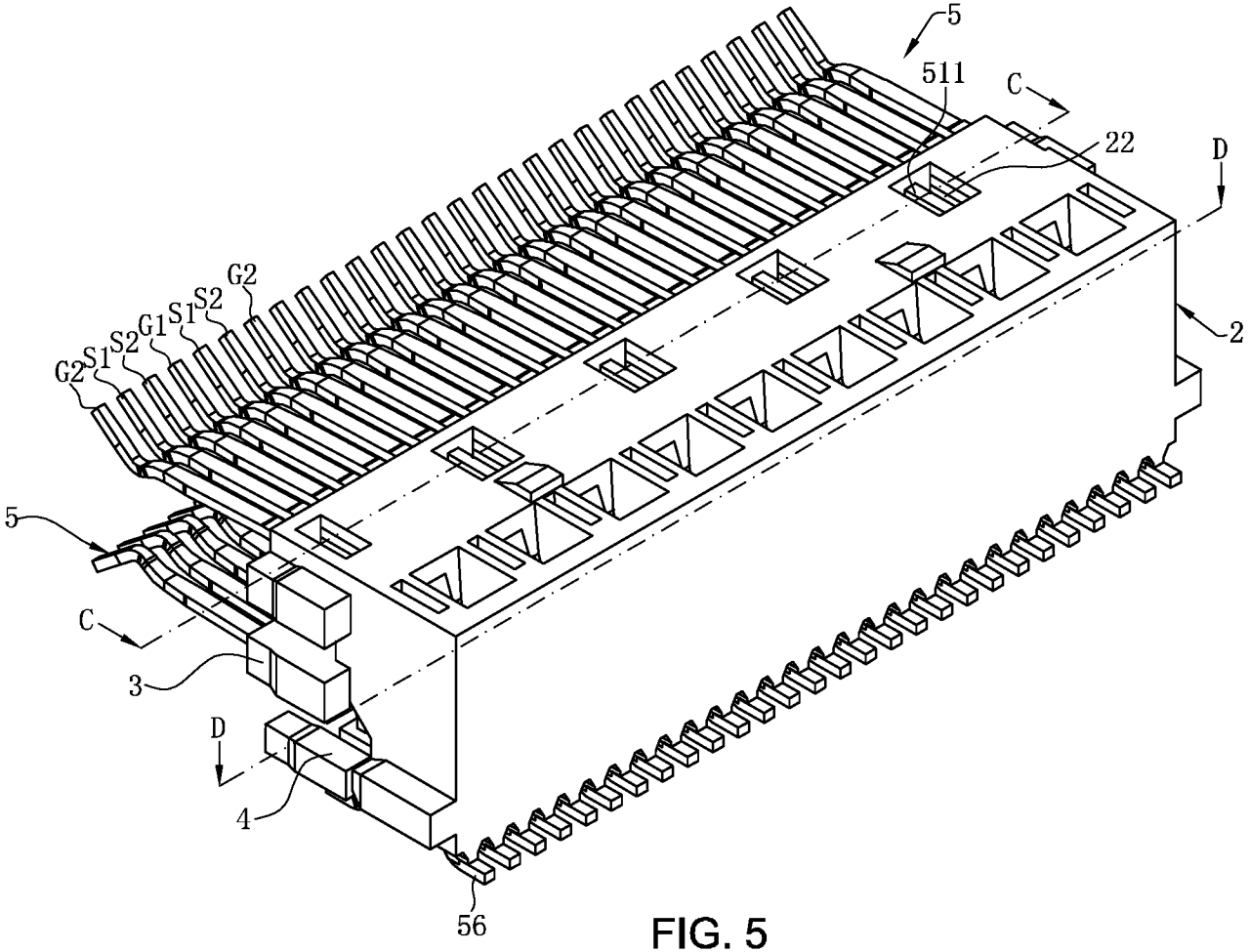
FIG. 5 is a perspective view of terminals in upper and lower rows of the electrical connector according to the first embodiment of the present invention.

As shown in FIG. 2, FIG. 5 and FIG. 6, each terminal 5 in the lower row is injection molded with the second insulating block 3 and the third insulating block 4 simultaneously. The fixing portion 51 of each terminal 5 in the lower row includes a first fixing portion 52 and a second fixing portion 53. The first fixing portion 52 is fixed in the second insulating block 3, and the second fixing portion 53 is fixed in the third insulating block 4. An extending portion 54 is formed by extending forward from the first fixing portion 52 to pass beyond the second front surface 31 but not to pass beyond the stopping surface 111. A contact arm 55 is formed by extending forward from the extending portion 54, and the contact arm 55 abuts the mating component 200. A soldering portion 56 is formed by extending downward from the second fixing portion 53, and the soldering portion 56 is soldered to the circuit board 300. Referring to FIG. 2, FIG. 4, FIG. 11 and FIG. 12, one of the second partitions 151 exists between any two adjacent extending portions 54 to reduce the interference between the extending portions 54 of the terminals 5 in the lower row. A first gap P1 exists between each second partition 151 and each of the extending portions 54. Further, the extending portion 54 and the contact arm 55 of each of the terminals 5 in the lower row are accommodated in the second receiving cavity 15, a second gap P2 exists between the extending portion 54 and the contact arm 55 of each of the terminals 5 in the lower row and an inner wall of the second receiving cavity 15, and air is located in the first gaps P1 and the second gaps P2. The extending portion 54 and the contact arm 55 of each of the terminals 5 in the lower row are accommodated in the second receiving cavity 15 and surrounded by the second partitions 151 and air, and the media surrounding them include mostly plastic medium and certain amount of air medium, thereby adjusting the impedance value of the extending portion 54 and the contact arm 55 of each of the terminals 5 in the lower row to be in a proper impedance range.

As shown in FIG. 2, a length of the fixing portion 51 of each of the terminals 5 in the upper row is greater than a length of the first fixing portion 51 of each of the terminals 5 in the lower row, and is also greater than a length of the second fixing portion 53 of each of the terminals 5 in the lower row. That is, the volume of each of the terminals 5 in the upper row fixed in the first insulating block 2 is greater than the volume of each of the terminals 5 in the lower row fixed in the second insulating block 3, and is also greater than the volume of each of the terminals 5 in the lower row fixed in the third insulating block 4. If each of the terminals 5 in the lower row is only fixed to the second insulating block 3 or is only fixed to the third insulating block 4, the volume not wrapped by the insulating blocks and exposed in the air will be excessive, resulting in the overall impedance value of the terminals 5 in the lower row to be high, which is not conductive to transmission of the high frequency signals. Thus, the terminals 5 in the lower row are fixed to the second insulating block 3 and the third insulating block 4 simultaneously to increase the volume of the fixing portion 51 of each of the terminals 5 in the lower row, thereby adjusting the impedance value of the extending portion 54 and the contact arm 55 of each of the terminals 5 in the lower row to be in a proper impedance range.

Figure 7:
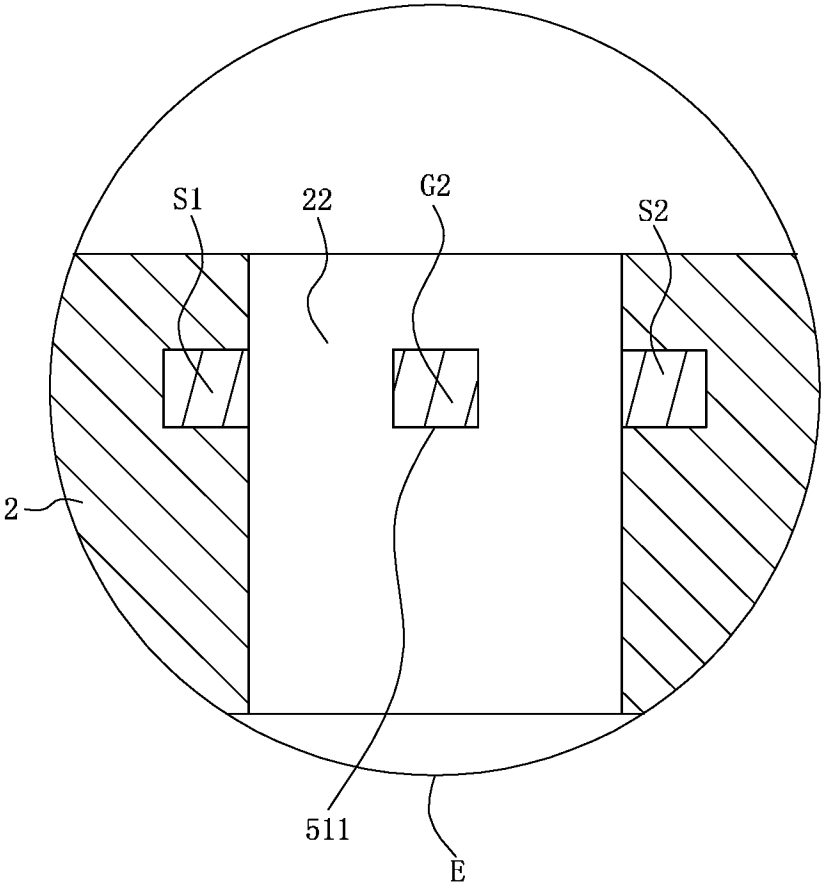
FIG. 7 is an enlarged view of a portion E in FIG. 6.
Figure 9:
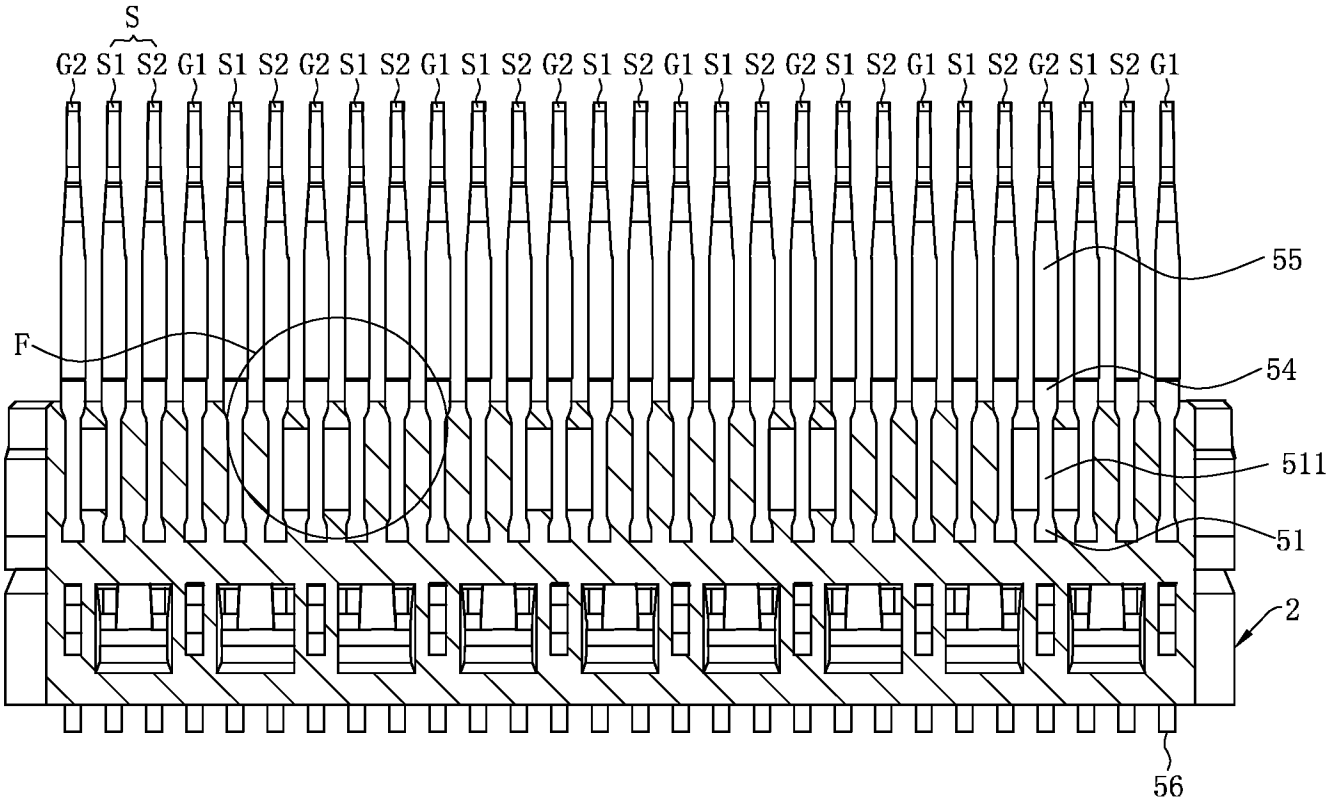
FIG. 9 is a sectional view of FIG. 5 along a line D-D.

As shown in FIG. 6, FIG. 7 and FIG. 9, the terminals 5 in each row include a plurality of first ground terminals G1, a plurality of second ground terminals G2, and a plurality of pairs of differential signal terminals S. Each pair of differential signal terminals S include a first signal terminal S1 and a second signal terminal S2. The terminals 5 in the upper row are arranged sequentially as: one of the first ground terminals G1, one pair of the differential signal terminals S, one of the second ground terminals G2, one pair of the differential signal terminals S, and one of the first ground terminals G1. That is, one of the first ground terminals G1 and one of the second ground terminals G2 are respectively at the two sides of each pair of the differential signal terminals S. The fixing portion 51 of each of the terminals 5 in the upper row further has an adjustment portion 511. Viewing downward from top thereof, the adjustment portion 511 of each of the second ground terminals G2 is exposed in a corresponding first opening hole 22, and the adjustment portion 511 of each of the first ground terminals G1 is not exposed in any of the first opening holes 22. The adjustment portion 511 of each of the second ground terminals G2 is exposed in the air, and the adjustment portion 511 of each of the first ground terminals G2 is not exposed in the air. Thus, the dielectric coefficient of the medium surrounding the adjustment portion 511 of each of the second ground terminals G2 is less than the dielectric coefficient of the medium surrounding the adjustment portion 511 of each of the first ground terminals G1, the electromagnetic energy of each of the second ground terminals G2 and the electromagnetic energy of each of the first ground terminals G1 are not identical, and the wave peaks of the electromagnetic wave of each of the second ground terminal G2 and the wave peaks of the electromagnetic wave of each of the first ground terminals G1 do not superimpose and add to each other, thereby reducing the resonance between the second ground terminals G2 and the first ground terminals G1, and preventing from the ground resonance.

As shown in FIG. 6 to FIG. 8, to allow more air medium to surround the adjustment portion 511 of each of the second ground terminals G2, the depth of each of the first opening holes 22 may be provided to allow the left and right side surfaces of the adjustment portion 511 of each of the second ground terminals G2 to be exposed in the corresponding first opening hole 22, such that the difference between the dielectric coefficient of the medium surrounding each of the second ground terminals G2 and the dielectric coefficient of the medium surrounding each of the first ground terminals G1 is increased, the difference between the electromagnetic energy of each of the second ground terminals G2 and the electromagnetic energy of each of the first ground terminals G1 is increased, and the wave peaks of the electromagnetic wave of each of the second ground terminal G2 and the wave peaks of the electromagnetic wave of each of the first ground terminals G1 do not superimpose and add to each other, thereby further reducing the resonance between the second ground terminals G2 and the first ground terminals G1, and further preventing from the ground resonance.

As shown in FIG. 6 to FIG. 8, a distance from a left side surface of a first opening hole 22 to the corresponding second ground terminal G2 is equal to a distance from a right side surface of the first opening hole 22 to the corresponding second ground terminal G2. The first opening hole 22 is symmetrical about the corresponding second ground terminal G2, and a distance from the adjustment portion 511 of the second signal terminal S2 at the left side of the corresponding second ground terminal G2 to the first opening hole 22 is equal to a distance from the adjustment portion 511 of the first signal terminal S1 at the right side of the corresponding second ground terminal G2 to the first opening hole 22. The first opening hole 22 is provided to affect both the pairs of the differential signal terminals S located at the two sides of the corresponding second ground terminal G2 in the same way, thus facilitating the balance between the pairs of the differential signal terminals S located at the two sides of the corresponding second ground terminal G2.

As shown in FIG. 6 to FIG. 8, a right side surface of the adjustment portion 511 of the second signal terminal S2 at the left side of the corresponding second ground terminal G2 and a left side surface of the adjustment portion 511 of the first signal terminal S1 at the right side of the corresponding second ground terminal G2 are both exposed in a same first opening hole 22, and the first opening hole 22 is from the right side surface of the adjustment portion 511 of the second signal terminal S2 at the left side of the corresponding second ground terminal G2 to the left side surface of the adjustment portion 511 of the first signal terminal S1 at the right side of the corresponding second ground terminal G2. By providing the first opening hole 22 between the pairs of differential signal terminals S and the corresponding second ground terminal G2, the media between the pairs of differential signal terminals S and the corresponding second ground terminal G2 become air from plastic, and the dielectric coefficients of the media surrounding the two are also reduced, thereby properly enhancing the impedance value of the electrical connector 100 to reach the best impedance range. Each of the adjustment portions 511 of each pair of differential signal terminals S has a side surface exposed in one of the first opening holes 22. Preferably, an area of the second signal terminal S2 at the left side of the corresponding second ground terminal G2 exposed in the first opening hole 22 is equal to an area of the first signal terminal S1 at the right side of the corresponding second ground terminal G2 exposed in the opening hole 22. The impedance values adjusted to the two pairs of differential signal terminals S at the two sides of the second ground terminal G2 are identical, and the impedance is balanced between the two pairs of differential signal terminals S, facilitating the stable transmission of high frequency signals.

As shown in FIG. 6, the width of each first opening hole 22 is the greatest at this time, such that more air medium surrounds the adjustment portion 511 of the corresponding second ground terminal G2, the difference between the dielectric coefficient of the medium surrounding each of the second ground terminals G2 and the dielectric coefficient of the medium surrounding each of the first ground terminals G1 is increased, the difference between the electromagnetic energy of each of the second ground terminals G2 and the electromagnetic energy of each of the first ground terminals G1 is increased, and the wave peaks of the electromagnetic wave of each of the second ground terminal G2 and the wave peaks of the electromagnetic wave of each of the first ground terminals G1 do not superimpose and add to each other, thereby further reducing the resonance between the second ground terminals G2 and the first ground terminals G1, and further preventing from the ground resonance.

As shown in FIG. 2 and FIG. 6, the terminals 5 in the lower row are arranged sequentially as: one of the second ground terminals G2, one pair of the differential signal terminals S, one of the first ground terminals G1, one pair of the differential signal terminals S, and one of the second ground terminals G2. The first fixing portion 52 of each of the terminals 5 in the lower row has a first adjustment portion 521, and the second fixing portion 53 of each of the terminals 5 in the lower row has a second adjustment portion 531. Viewing upward from bottom thereof, the first adjustment portion 521 of each of the second ground terminals G2 is exposed in a corresponding second opening hole 32, and the second adjustment portion 531 of each of the second ground terminals G2 is exposed in a corresponding third opening hole 42. The first adjustment portion 521 of each of the first ground terminals G1 is not exposed in any of the second opening holes 32, and the second adjustment portion 531 of each of the first ground terminals G1 is not exposed in any of the third opening holes 42. The first adjustment portion 521 and the second adjustment portion 531 of each of the second ground terminals G2 are both exposed in the air, and the first adjustment portion 521 and the second adjustment portion 531 of each of the first ground terminals G2 are not exposed in the air. Thus, the dielectric coefficient of the medium surrounding the first adjustment portion 521 and the second adjustment portion 531 of each of the second ground terminals G2 are less than the dielectric coefficient of the medium surrounding the first adjustment portion 521 and the second adjustment portion 531 of each of the first ground terminals G1, the electromagnetic energy of each of the second ground terminals G2 and the electromagnetic energy of each of the first ground terminals G1 are not identical, and the wave peaks of the electromagnetic wave of each of the second ground terminal G2 and the wave peaks of the electromagnetic wave of each of the first ground terminals G1 do not superimpose and add to each other, thereby reducing the resonance between the second ground terminals G2 and the first ground terminals G1, and preventing from the ground resonance.

As shown in FIG. 6, in the terminals in the upper and lower rows, the second ground terminals G2 in the upper row and the second ground terminals G2 in the lower row are staggered. That is, the first opening holes 22 and the second opening holes 32 are also staggered. The electromagnetic energies of the first ground terminals G1 in the upper row and the second ground terminals G2 in the lower row or the second ground terminals G2 in the upper row and the first ground terminals G1 in the lower row are different, and the wave peaks of the electromagnetic wave of the two do not superimpose and add to each other, thereby reducing the resonance between the two, and preventing from the ground resonance.

As shown in FIG. 2, FIG. 4 and FIG. 6, the third insulating block 4 has an opening slot 43. The second fixing portion 53 of each of the terminals 5 in the lower row is fixed to the third insulating block 4, and the second adjustment portion 531 of each of the terminals 5 in the lower row is partially exposed in the opening slot 43. The third insulating block 4 is assembled and accommodated in the third receiving cavity 16. A protruding block 161 is provided in the third receiving cavity 16, and the protruding block 161 is accommodated in the opening slot 43. The protruding block 161 does not abut the second adjustment portion 531. A third gap exists between the second adjustment portion 531 of each of the terminals 5 in the lower row and the protruding block 161, and air is located in the third gap, thus adjusting the impedance value of the terminals 5 in the lower row to a proper impedance range.

Figure 10:
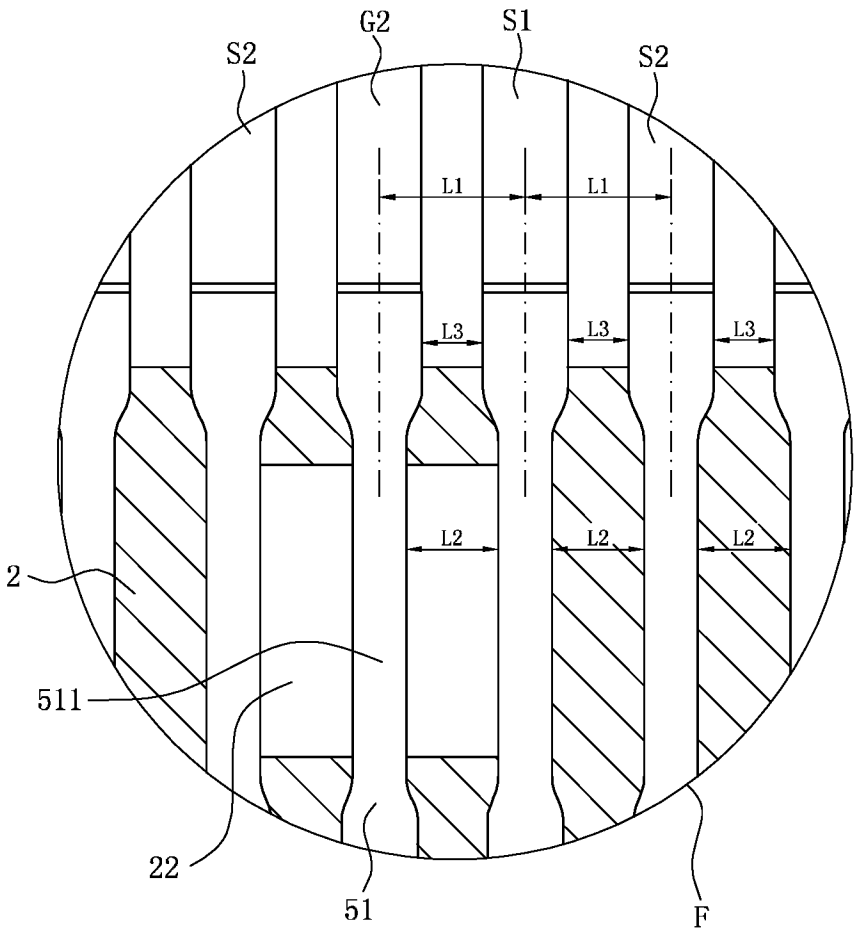
FIG. 10 is an enlarged view of a portion F in FIG. 9.

As shown in FIG. 9 and FIG. 10, taking the terminals 5 in the upper row as an example, the width of the adjustment portion 511 is less than the width of the extending portion 54. A center distance L1 between each portions of the two adjacent ones of the terminals 5 is identical. A distance between the adjustment portions 511 of two adjacent ones of the terminals 5 is defined as a first interval L2, and a distance between the extending portions 54 of two adjacent ones of the terminals 5 is defined as a second interval L3. The first interval L2 is greater than the second interval L3. The width of the adjustment portion 511 is relatively small, and the opening holes can be provided to be sufficiently large, such that a difference between the resonance frequency of the second ground terminals G2 and the resonance frequency of the first ground terminals G1 is increased, thereby further reducing the resonance between the second ground terminals G2 and the first ground terminals G1, and further preventing from the ground resonance.

Figure 11:
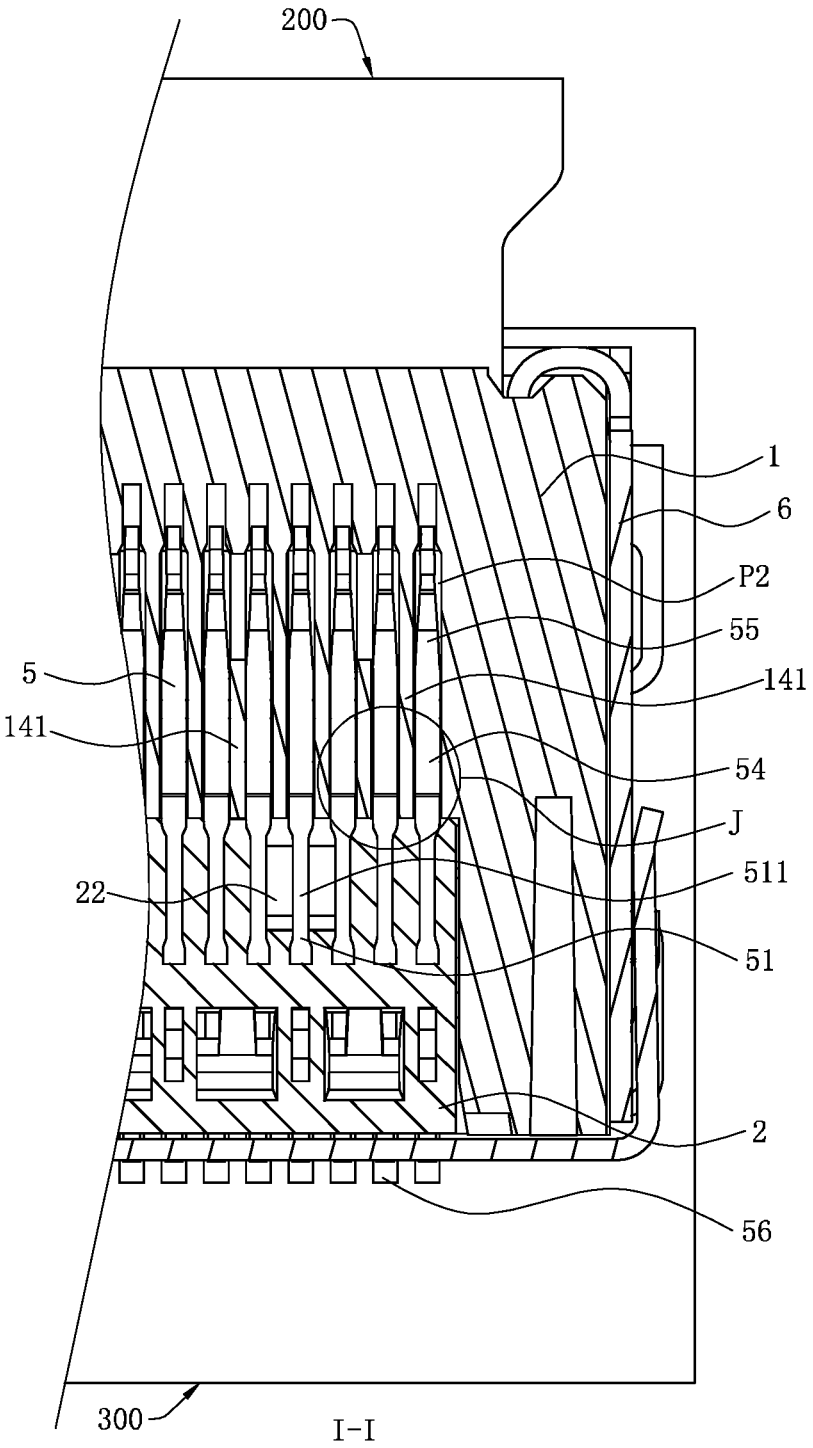
FIG. 11 is a partial sectional view of FIG. 1 along a line I-I.
Figure 12:
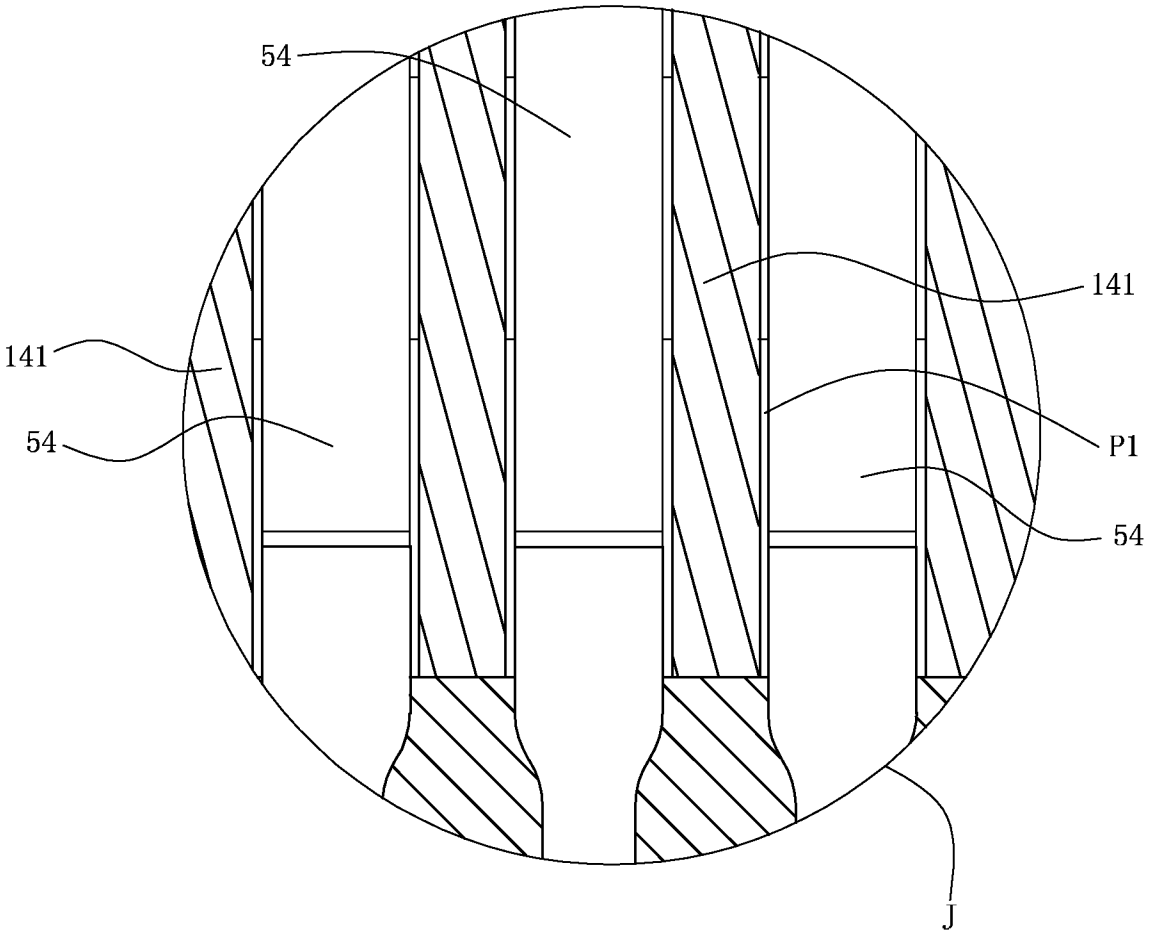
FIG. 12 is an enlarged view of a portion J in FIG. 11.

As shown in FIG. 4, FIG. 9 and FIG. 10, a center distance L1 refers to one virtual center line to another virtual center line, and a distance refers to an interval between the two components. The impedance of each terminal 5 is inversely proportional to the dielectric coefficient of the medium surrounding each terminal 5. Referring to FIG. 2, FIG. 11 and FIG. 12, the second gap P2 exists between the extending portion 54 of each terminal 5 and the inner wall of the first receiving cavity 14, and the first gap P1 exists between the extending portion 54 of each terminal 5 and the first partition 141. More air medium exists around the extending portion 54, such that the impedance and energy of the extending portion 54 are higher, and more energy may be reflected out. The second interval L3 between the extending portion 54 of the second ground terminal G2 and the extending portion 54 of one of its adjacent pairs of differential signal terminals S is small, and the first partitions 141 exists between the extending portion 54 of the second ground terminal G2 and the extending portion 54 of one of its adjacent pairs of differential signal terminals S, such that capacitance is large, coupling is better, facilitating the second ground terminal G2 to absorb the energy being reflected by the adjacent pairs of the differential signal terminals S, thereby reducing the effect of each pair of the differential signal terminals S to other adjacent pairs of the differential signal terminals S. The adjustment portions 511 of each pair of the differential signal terminals S are almost wrapped by the first insulating block 2, and the medium surrounding them has more plastic medium, such that the impedance and the energy of each pair of the differential signal terminals S are low. The first opening hole 22 is provided between the adjustment portion 511 of the second ground terminal G2 and the adjustment portion 511 of one of its adjacent pairs of differential signal terminals S, and the width of each adjustment portion 511 is reduced, such that the first interval L2 between the adjustment portion 511 of the second ground terminal G2 and the adjustment portion 511 of one of its adjacent pairs of differential signal terminals S is increased, more air medium exists between the two components, such that capacitance is smaller, coupling is relatively low, thereby reducing the effect of the second ground terminal G2 to its adjacent pairs of the differential signal terminals S.

As shown in FIG. 3, FIG. 9 and FIG. 10, to each pair of the differential signal terminals S, the first partition 141 and air exist between the extending portions 54 of each pair of the differential signal terminals S, and the first insulating block 2 exists between the adjustment portions 511 of each pair of the differential signal terminals S. Thus, the dielectric coefficient of the media surrounding the adjustment portions 511 of each pair of the differential signal terminals S is greater than the dielectric coefficient of the media surrounding the extending portions 54 of each pair of the differential signal terminals S, and the impedances of the adjustment portions 511 of each pair of the differential signal terminals S is less than the impedances of the extending portions 54 of each pair of the differential signal terminals S. The impedance of each differential signal terminal may change from the extending portion 54 to the adjustment portion 511, and the change of impedance is not conductive to the stable high speed transmission of the signals. Thus, by reducing the width of the adjustment portions 511, the first interval L2 between the adjustment portions 511 of each pair of the differential signal terminals S is increased, properly enhancing the impedance of the pair of the differential signal terminals S, reducing the impedance change of the pair of the differential signal terminals S, and facilitating the stable high speed transmission of the signals. The first opening hole 22 is provided at a side close to the first front surface 21, reducing a distance between the extending portion 54 and the adjustment portion 511, reducing the distance of the impedance change, and buffering the ill effect of the impedance change. The characteristics of the terminals 5 in the lower row are substantially identical to those of the terminals 5 in the upper row, and are thus not elaborated herein.

Figure 13:
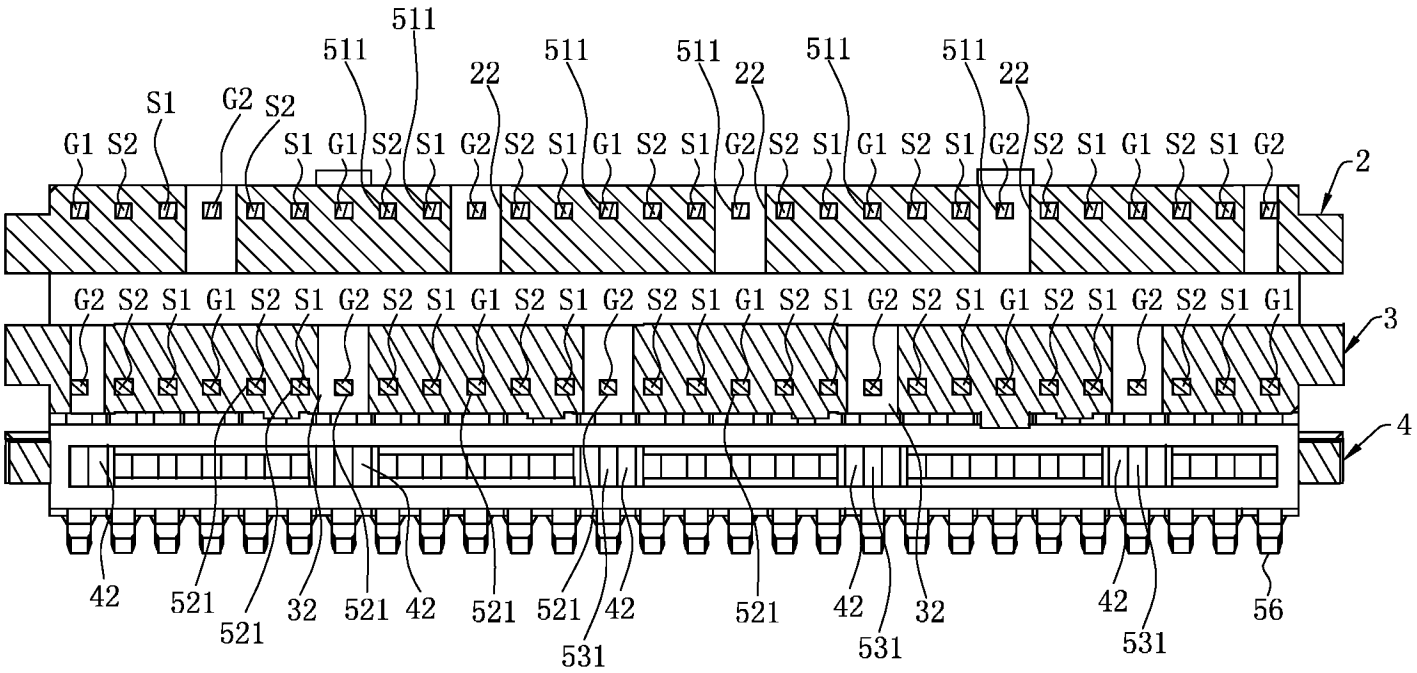
FIG. 13 is a sectional view of an electrical connector according to a second embodiment of the present invention.

As shown in FIG. 13, in the second embodiment of the present invention, the right side surface of the adjustment portion 511 of the second signal terminal S2 at the left side of the corresponding second ground terminal G2 and the left side surface of the adjustment portion 511 of the first signal terminal S1 at the right side of the corresponding second ground terminal G2 are both not exposed in the first opening hole 22, as long as the impedance values adjusted to the two pairs of differential signal terminals S at the two sides of the second ground terminal G2 are ensured to be identical, such that the impedance is balanced between the two pairs of differential signal terminals S.

To sum up, the electrical connector 100 according to certain embodiments of the present invention has the following beneficial effects:

1. The adjustment portion 511 of each of the second ground terminals G2 is exposed in a corresponding first opening hole 22 along a vertical direction, and the adjustment portion 511 of each of the first ground terminals G1 is not exposed in any of the first opening holes 22. The adjustment portion 511 of each of the second ground terminals G2 is exposed in the air, and the adjustment portion 511 of each of the first ground terminals G2 is not exposed in the air. Thus, the dielectric coefficient of the medium surrounding the adjustment portion 511 of each of the second ground terminals G2 is less than the dielectric coefficient of the medium surrounding the adjustment portion 511 of each of the first ground terminals G1, the electromagnetic energy of each of the second ground terminals G2 and the electromagnetic energy of each of the first ground terminals G1 are not identical, and the wave peaks of the electromagnetic wave of each of the second ground terminal G2 and the wave peaks of the electromagnetic wave of each of the first ground terminals G1 do not superimpose and add to each other, thereby reducing the resonance between the second ground terminals G2 and the first ground terminals G1, and preventing from the ground resonance.

2. The width of the adjustment portion 511 is less than the width of the extending portion 54. A center distance L1 between each portions of the two adjacent ones of the terminals 5 is identical. The first interval L2 between the adjustment portions 511 of two adjacent ones of the terminals 5 is greater than the second interval L3 between the extending portions 54 of two adjacent ones of the terminals 5. The width of the adjustment portion 511 is relatively small, and the opening holes can be provided to be sufficiently large, such that a difference between the resonance frequency of the second ground terminals G2 and the resonance frequency of the first ground terminals G1 is increased, thereby further reducing the resonance between the second ground terminals G2 and the first ground terminals G1, and further preventing from the ground resonance.

3. In the terminals in the upper and lower rows, the second ground terminals G2 in the upper row and the second ground terminals G2 in the lower row are staggered. That is, the first opening holes 22 and the second opening holes 32 are also staggered. The electromagnetic energies of the first ground terminals G1 in the upper row and the second ground terminals G2 in the lower row or the second ground terminals G2 in the upper row and the first ground terminals G1 in the lower row are different, and the wave peaks of the electromagnetic wave of the two do not superimpose and add to each other, thereby reducing the resonance between the two, and preventing from the ground resonance.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating block, having at least one opening hole along a vertical direction thereof; and a plurality of terminals arranged in at least one row along a left-right direction of the insulating block, wherein each of the terminals has a fixing portion fixed to the insulating block, and the fixing portion has an adjustment portion, wherein the terminals in one row comprise at least two first ground terminals, at least one second ground terminal and at least two pairs of differential signal terminals, correspondingly arranged along the left-right direction sequentially as: one of the first ground terminals, one of the pairs of differential signal terminals, one of the second ground terminals, another one of the pairs of differential signal terminals, and another one of the first ground terminals, wherein the adjustment portion of each of the at least one second ground terminal is exposed in the opening hole along the vertical direction, and the adjustment portion of each of the at least two first ground terminals is not exposed in the opening hole.

2. The electrical connector according to claim 1, wherein a left side surface and a right side surface of the adjustment portion of each of the at least one second ground terminal are exposed in the opening hole.

3. The electrical connector according to claim 2, wherein a distance from a left side surface of the opening hole to the second ground terminal is equal to a distance from a right side surface of the opening hole to the second ground terminal.

4. The electrical connector according to claim 1, wherein each of the pairs of differential signal terminals comprises a first signal terminal and a second signal terminal, and a right side surface of the adjustment portion of the second signal terminal of the one of the pairs of differential signal terminals at a left side of the second ground terminal and a left side surface of the adjustment portion of the first signal terminal of the another one of the pairs of differential signal terminals at a right side of the second ground terminal are at least partially exposed in a same opening hole.

5. The electrical connector according to claim 4, wherein an area of the second signal terminal of the one of the pairs of differential signal terminals at the left side of the second ground terminal exposed in the opening hole is equal to an area of the first signal terminal of the another one of the pairs of differential signal terminals at the right side of the second ground terminal exposed in the opening hole.

6. The electrical connector according to claim 1, wherein each of the pairs of differential signal terminals comprises a first signal terminal and a second signal terminal, and a right side surface of the adjustment portion of the second signal terminal of the one of the pairs of differential signal terminals at a left side of the second ground terminal and a left side surface of the adjustment portion of the first signal terminal of the another one of the pairs of differential signal terminals at a right side of the second ground terminal are not exposed in a same opening hole.

7. The electrical connector according to claim 1, further comprising an insulating body, wherein the insulating body has an insertion slot concavely provided backward for a mating component to insert therein, the insertion slot has a stopping surface, the mating component abuts the stopping surface, the insulating block is located in the insulating body, a front end of the insulating block has a front surface located behind the stopping surface, each of the terminals has an extending portion extending forward from the fixing portion to pass beyond the front surface but not to pass beyond the stopping surface, a partition exists between any two adjacent ones of the extending portions of the terminals in a same row, a first gap exists between the partition and each of the two adjacent ones of the extending portions, and air is located in the first gap.

8. The electrical connector according to claim 7, wherein the opening hole is provided at a side close to the front surface, the insulating body has a receiving cavity, the insulating block and the terminals in one row are located in the receiving cavity, a second gap exists between each of the terminals and an inner wall of the receiving cavity, and air is located in the second gap.

9. The electrical connector according to claim 7, wherein a width of the adjustment portion is less than a width of the extending portion, and a distance between the adjustment portions of two adjacent of the terminals in the same row is greater than a distance between the extending portions of the two adjacent of the terminals in the same row.

10. The electrical connector according to claim 1, comprising two insulating blocks, wherein the terminals are arranged in an upper row and a lower row and aligned vertically, the terminals in one of the two rows comprise at least two first ground terminals, at least one second ground terminal and at least two pairs of differential signal terminals, the terminals in the other of the two rows comprise at least one first ground terminal, at least two second ground terminals and at least two pairs of differential signal terminals, and the opening holes on the two insulating blocks are staggered along the vertical direction of the insulating blocks.

11. The electrical connector according to claim 1, comprising three insulating blocks, wherein the three insulating blocks comprise a first insulating block, a second insulating block and a third insulating block, the terminals are arranged in an upper row and a lower row, the terminals in the upper row are injection molded with the first insulating block, the fixing portions of the terminals in the upper row are fixed to the first insulating block, the terminals in the lower row are injection molded with the second insulating block and the third insulating block, the fixing portion of each of the terminals in the lower row comprises a first fixing portion and a second fixing portion, the first fixing portion is fixed to the second insulating block, the second fixing portion is fixed to the third insulating block, a length of the fixing portion of each of the terminals in the upper row is greater than a length of the first fixing portion of each of the terminals in the lower row, and the length of the fixing portion of each of the terminals in the upper row is greater than a length of the second fixing portion of each of the terminals in the lower row.

12. The electrical connector according to claim 11, wherein the first fixing portion of each of the terminals in the lower row has a first adjustment portion, the second fixing portion of each of the terminals in the lower row has a second adjustment portion, the first adjustment portion and the second adjustment portion of each of the second ground terminals in the lower row are both exposed in the opening hole, and the first adjustment portion and the second adjustment portion of the first ground terminal in the lower row are not exposed in the opening hole.

* * * * *